US006791522B2

(12) United States Patent
Yi et al.

(10) Patent No.: US 6,791,522 B2
(45) Date of Patent: Sep. 14, 2004

(54) TRIODIC RECTIFIER SWITCH

(75) Inventors: Choong-Hoon Yi, Seoul (KR); Gregory S. Um, Torrance, CA (US); Sun-Hee Yang, Seoul (KR); Chang-Su Seo, Seoul (KR); Song-Yi Lee, Seoul (KR)

(73) Assignee: Samsung SDI Co., Ltd, Suwon (KR)

( * ) Notice: Subject to any disclaimer, the term of this patent is extended or adjusted under 35 U.S.C. 154(b) by 349 days.

(21) Appl. No.: 09/989,434

(22) Filed: Nov. 21, 2001

(65) Prior Publication Data

US 2002/0063683 A1 May 30, 2002

(30) Foreign Application Priority Data

Nov. 29, 2000 (KR) ..... 2000-71451

(51) Int. Cl.[7] ..... G09G 3/36
(52) U.S. Cl. ..... 345/91; 345/92
(58) Field of Search ..... 345/91, 92–100, 345/87, 204, 208, 211, 213; 438/30; 257/59; 349/40; 313/310

(56) References Cited

U.S. PATENT DOCUMENTS 4,983,022 A 1/1991 Shannon
5,014,048 A 5/1991 Knapp
5,025,250 A 6/1991 Hains
5,069,534 A 12/1991 Hirai
5,117,298 A * 5/1992 Hirai ..... 345/96
5,122,889 A 6/1992 Kaneko et al.
5,508,591 A 4/1996 Kanemori et al.
5,637,187 A * 6/1997 Takasu et al. ..... 438/30
5,847,797 A 12/1998 Van Dijk
5,852,425 A * 12/1998 Bird et al. ..... 345/92
5,886,365 A * 3/1999 Kouchi et al. ..... 257/59
5,905,484 A 5/1999 Verhulst
5,909,264 A 6/1999 Fujikawa et al.
5,952,991 A 9/1999 Akiyama
6,037,708 A * 3/2000 Potter ..... 313/310
6,067,062 A * 5/2000 Takasu et al. ..... 345/87
6,072,457 A 6/2000 Hashimoto et al.
6,271,050 B1 8/2001 Akiba et al.
6,304,241 B1 * 10/2001 Udo et al. ..... 345/96
6,445,427 B1 * 9/2002 Lee et al. ..... 349/40
6,498,596 B1 * 12/2002 Nakamura et al. ..... 345/98

* cited by examiner

*Primary Examiner*—Amare Mengistu
*Assistant Examiner*—Prabodh M. Dharia
(74) *Attorney, Agent, or Firm*—Robert E. Bushnell, Esq.

(57) ABSTRACT

A triodic rectifier switch includes at least one first diode connected to a data line, at least two second diodes connected to a load capacitor, a resistor having one terminal connected to a scan line and the other terminal connected to a node between the first diodes and the second diodes. The triode rectifier switch further includes at least one reset diode having one terminal connected to a node between the first and second diodes and the other terminal connected to a reset line. The second diodes are serially-connected to each other.

18 Claims, 3 Drawing Sheets

TRIODIC RECTIFIER SWITCH

CLAIM OF PRIORITY

This application makes reference to, incorporates the same herein, and claims all benefits accruing under 35 U.S.C. § 119 from an application for TRIODIC RECTIFIER SWITCH earlier filed in the Korean Industrial Property Office on Nov. 29, 2000 and there duly assigned Serial No. 2000-71451.

BACKGROUND OF THE INVENTION

1. Field of the Invention

The present invention relates to a triodic rectifier switch (TRS) and more particularly to a triodic rectifier switch for a display device.

2. Description of Related Art

The triode rectifier switch is one of those used as a switching element of, for example, a flat panel display device such as a liquid crystal display (LCD) device and an organic EL (electroluminescent) display.

The triode rectifier switch is simpler in the manufacturing process and lower in cost than a thin film transistor (TFT). Also, the triode rectifier switch has advantages in that it can independently control a signal voltage differently from other switching elements, and it has low leakage current characteristics different from a switching element having a combination of a diode and a capacitor.

When a flat panel display is driven using such a triode rectifier switch, a very low off-current is required to obtain a good gray scale.

However, the conventional triode rectifier switch generates a very high off-current or leakage current by a reverse bias voltage due to its material property. For example, the leakage current is generated at the interface between ITO (indium tin oxide, i.e., upper electrode) and semiconductor layer.

Electric characteristics or I–V characteristics depend on an on-current/off-current ratio and a leakage current. Therefore, the conventional triode rectifier switch has very bad electric characteristics. Also, the leakage current deteriorates the gray scale.

Exemplars of the art are U.S. Pat. No. 6,072,457 issued to Hashimoto et al., for Display and its Driving Method, U.S. Pat. No. 5,909,264 issued to Fujikawa et al., for LCD Device Having a Switching Element with Reduced Size and Capacitance and Method for Fabricating the Same, U.S. Pat. No. 5,952,991 issued to Akiyama, for Liquid Crystal Display, U.S. Pat. No. 5,905,484 issued to Verhulst, for Liquid Crystal Display Device with Control Circuit, U.S. Pat. No. 5,847,797 issued to Van Dijk, for Display Device, U.S. Pat. No. 5,508,591 issued to Kanemori et al., for Active Matrix Display Device, U.S. Pat. No. 5,122,889 issued to Kaneko et al., for Active Matrix Liquid Crystal Display Using MIM Diodes Having Symmetrical Voltage-current Characteristics as Switching Elements, U.S. Pat. No. 4,983,022 issued to Shannon, for Liquid Crystal Display Device, U.S. Pat. No. 5,069,534 issued to Hirai, for Active Matrix Liquid Crystal Display with Series-connected MIM Structures as a Switching Element, U.S. Pat. No. 6,271,050 issued to Akiba et al, for Method of Manufacturing Thin Film Diode, U.S. Pat. No. 5,025,250 issued to Hains, for Matrix Display Device, and U.S. Pat. No. 5,014,048 issued to Knapp, for Matrix Display Systems.

SUMMARY OF THE INVENTION

It is therefore an object of the present invention provide a triodic rectifier switch having excellent electric characteristics.

It is another object to have a switching element for a display device that is easy to manufacture.

It is yet another object to have a switching element for a display device that is inexpensive.

In order to achieve the above and other objects, the preferred embodiments of the present invention provide a triodic rectifier switch (TRS). The triode rectifier switch includes at least one first diode connected to a data line, at least two second diodes connected to a load capacitor, and a resistor having one terminal connected to a scan line and the other terminal connected to a node between the first diodes and the second diodes. The triode rectifier switch further includes at least one reset diode having one terminal connected to a node between the first and second diodes and the other terminal connected to a reset line.

The second diodes are serially-connected to each other. The first to third diodes are a junction diode, a schottky diode or an MIM-diode (metal-insulator-metal diode).

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF PREFERRED EMBODIMENTS

Figure 1:
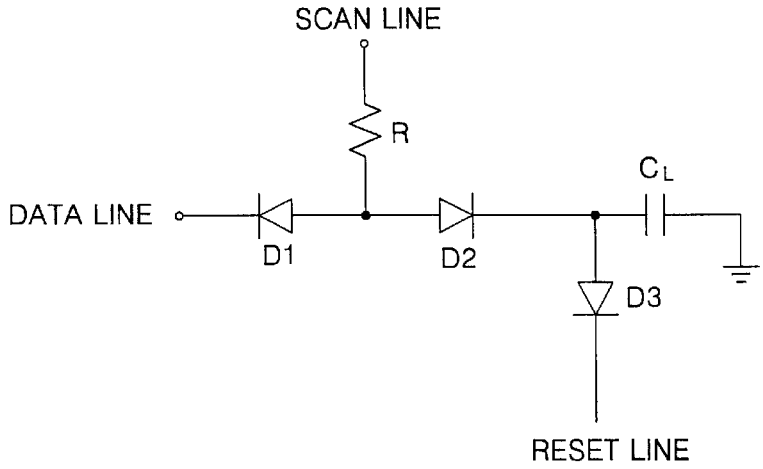
FIG.1 (PRIOR ART)
FIG. 1 is a circuit diagram illustrating a conventional triode rectifier switch.

Turning now to the drawings, FIG. 1 is a circuit diagram illustrating an earlier triode rectifier switch. The triode rectifier switch includes two diodes D1 and D2, and one resistor R. The diode D1 is connected to a data line, and the diode D2 is connected to a load capacitor $C_L$ (e.g., a display pixel). The resistor R has one terminal to be connected to a scan line and the other terminal connected between the diodes D1 and D2. The triode rectifier switch further includes a reset diode D3 having one terminal connected between the diode D2 and the load capacitor $C_L$ and the other terminal connected to a reset line.

FIG. 1 shows the positive triode rectifier switch. In case of a negative triode rectifier switch, the diodes D1 to D3 are arranged in the opposite direction.

Each of the diodes D1 to D3 includes a lower electrode, a doping layer, a semiconductor layer, and an upper electrode, which are stacked. The positive triode rectifier switch has the upper electrode as a cathode, the lower electrode as an anode, and the p-type semiconductor layer. The negative triode rectifier switch has the upper electrode as an anode, the lower electrode as a cathode, and the n-type semiconductor layer.

An operation of the triode rectifier switch of FIG. 1 is as follows.

First, in case of the positive triode rectifier switch, a voltage is applied to the scan line to charge the load capacitor $C_L$. The voltage is continuously applied to the scan line in order to maintain a charged state of the load capacitor $C_L$. A gray scale is controlled by a voltage applied to the data line. After a predetermined time period, in order to apply next data, a voltage of 0 volts is applied to the scan line, and the reset diode D3 is turned on to discharge the load capacitor $C_L$.

In case of the negative triode rectifier switch, the reset diode D3 is turned on to charge the load capacitor $C_L$. A predetermined level of a voltage is applied to the scan line in order to maintain a charged state of the load capacitor $C_L$. A gray scale is controlled by a voltage applied to the data line. After a predetermined time period, in order to apply the next data, a sufficiently low voltage is applied to the scan line to discharge the load capacitor $C_L$.

Meanwhile, when a flat panel display (e.g. LCD or organic EL display) is driven using such a triode rectifier switch, a very low off-current is required to obtain a good gray scale.

However, the triode rectifier switch generates a very high off-current or leakage current by a reverse bias voltage due to its material property. For example, the leakage current is generated at the interface between ITO (indium tin oxide, i.e., upper electrode) and semiconductor layer.

Electric characteristics or I–V characteristics depend on an on-current/off-current ratio and a leakage current. Therefore, the earlier triode rectifier switch has very bad electric characteristics. Furthermore, the leakage current deteriorates the gray scale.

Figure 2:
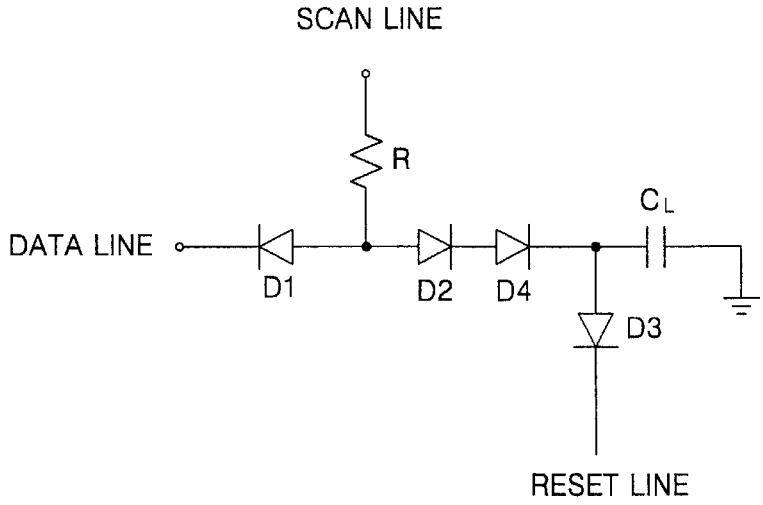
FIG. 2 is a circuit diagram illustrating a positive triode rectifier switch according to a preferred embodiment of the present invention.

FIG. 2 is a circuit diagram illustrating a triode rectifier switch according to a preferred embodiment of the present invention. The triode rectifier switch includes at least one first diode D1, at least two second diodes D2 and D4, and one resistor R.

The first diode D1 is connected to a data line, and the second diodes D2 and D4 are connected to a load capacitor $C_L$ (e.g., a display pixel). The resistor R has one terminal connected to a scan line and the other terminal connected to a node between the first diodes D1 and the second diodes D2. The triode rectifier switch further includes at least one reset diode D3 having one terminal connected between the second diode D4 and the load capacitor $C_L$ and the other terminal connected to a reset line. The second diodes D2 and D4 are serial-connected to each other.

Figure 3:
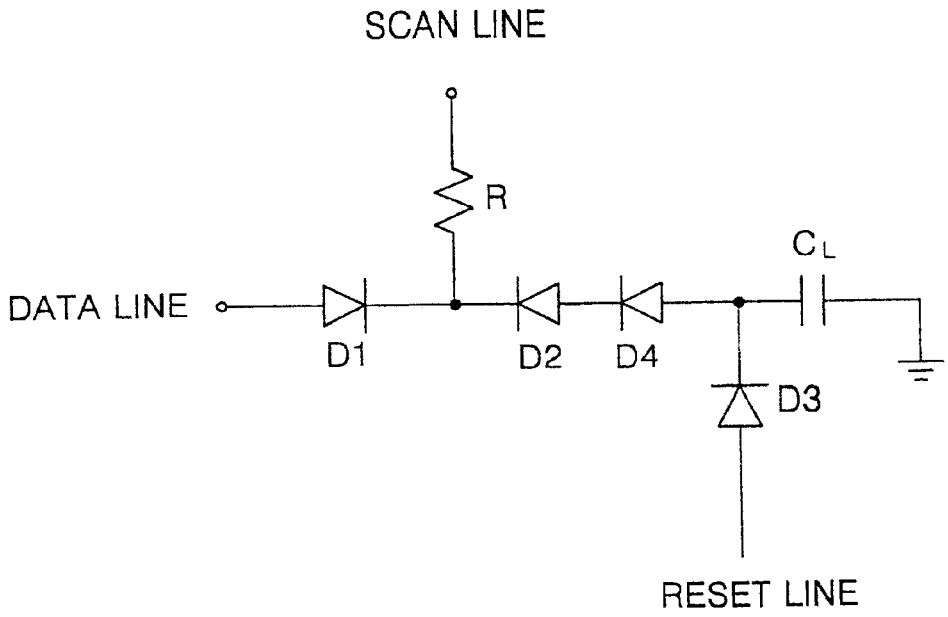
FIG. 3 is a circuit diagram illustrating a negative triode rectifier switch according to a preferred embodiment of the present invention.

FIG. 2 shows the positive triode rectifier switch. In case of a negative triode rectifier switch, arrangement direction of the diodes D1 to D4 is contrarily changed as seen FIG. 3.

The triode rectifier switch of FIG. 2 performs the same operation as that of FIG. 1, and thus its explanation is omitted.

Any kind of diode can be applied for D1 to D4 in the present invention. For example, the diodes D1 to D4 are a junction diode, a schottky diode or an MIM (metal-insulator-metal) diode. References D1, D2, D3, D4 can also be structures equivalent to a diode.

In order to examine I–V characteristics, an exemplary triode rectifier switch is manufactured, based on the circuit diagram of FIG. 2. Each of the diodes D1 to D4 of the exemplary triode rectifier switch has the following structure: Cr(lower electrode)/$n^+$-doping layer/intrinsic a-Si:H (semiconductor layer)/ITO(upper electrode).

According to the present invention, the display is operated by supplying (+) voltage to the reset line, and supplying (+) voltage (turn on) from the switch-on-off signal (scan line signal) to the display pixel through D2 and D4 which are serially connected to the data line and display pixel.

Then, when the switch signal (−) voltage (turn off) is supplied from the switch on-off(scan) signal, D2 and D4 connected to the display pixel $C_L$ is turned on by switch on-off signal, so that the pixel voltage of the display pixel is discharged to switch-on-off signal through D2, D4, and R1 and turned off.

With respect to the electric characteristics (characteristics of off electric current (I) in response to voltage (V)) of D2 and D4 serially connected to display pixel when the display pixel is turned on or off by the TRS, the electric characteristics depend on the ratio of the on and off switch, leakage current and slope and thus off current of the display pixel is decreased more by the characteristics of the diode when D4 is serially connected to D2 than when the display pixel is connected to D2.

Figure 4:
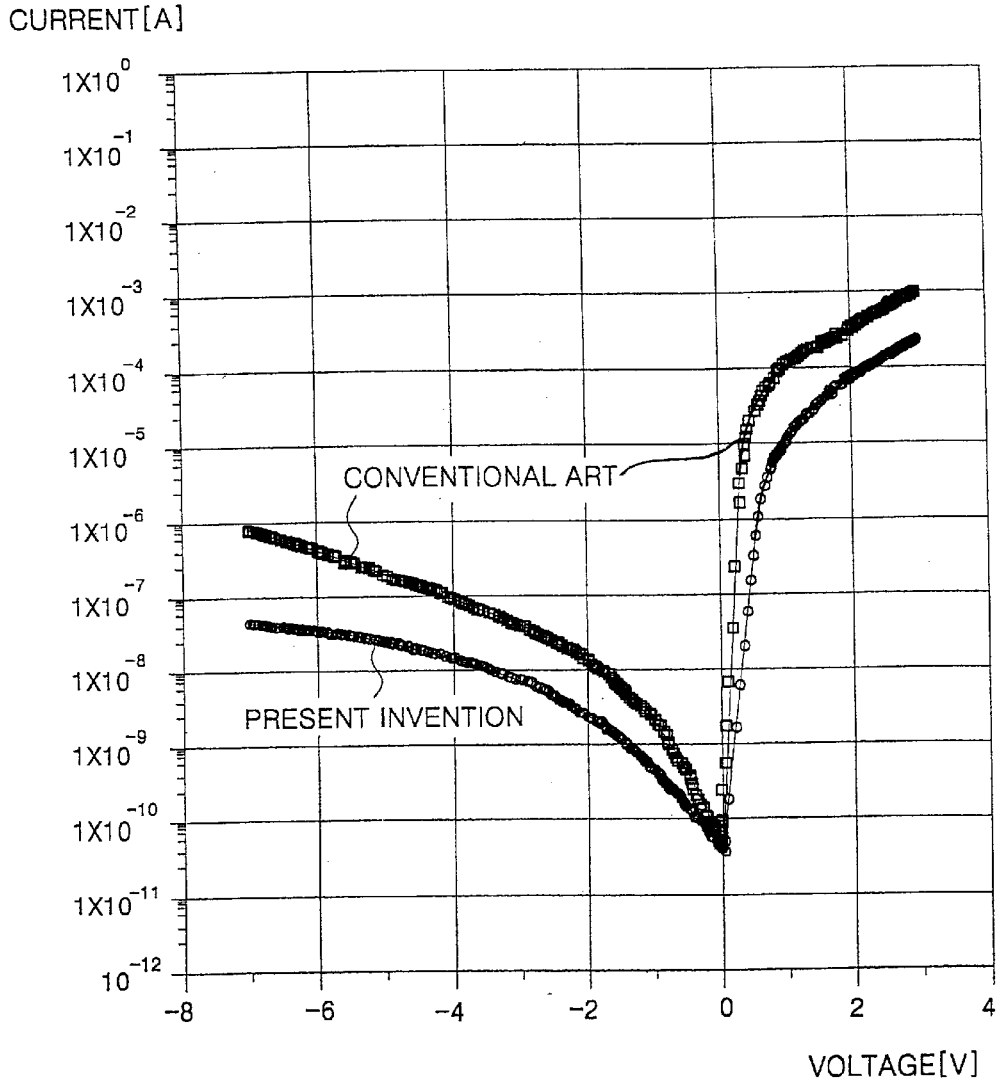
FIG. 4 is a graph illustrating I–V characteristics of the triode rectifier switch exemplarily manufactured according to the preferred embodiment of the present invention.

FIG. 4 shows I–V characteristics of the exemplary triode rectifier switch. As can be seen in FIG. 4, an off-current or leakage current is sufficiently lowered. In other words, in comparison to the triode rectifier switch of FIG. 1, the triode rectifier switch of FIG. 2 is as lowered in off-current as $1\times10^{-1}$ A (Amperes).

Therefore, it is understood that the triode rectifier switch according to the preferred embodiment of the present invention has a good gray scale and an excellent electric characteristics.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A triodic rectification switch, comprising:

a first diode connected to a data line;

two second diodes connected to a load capacitor; and a resistor having one terminal connected to a scan line and the other terminal connected to a node between the first and second diodes.

2. The switch of claim 1, further comprising, at least one third diode having one terminal connected to a node between the second diodes and the load capacitor and the other terminal connected to reset line.

3. The switch of claim 1, further comprised of the second diodes being connected in series to each other.

4. The switch of claim 2, further comprised of at least one of the first, second, and third diodes being a junction diode.

5. The switch of claim 2, further comprised of at least one of the first, second, and third diodes being a schottky diode.

6. The switch of claim 2, further comprised of at least one of the first, second, and third diodes being a metal-insulator-metal diode.

7. A switching element for a display device, comprising:

a first unit connected to a data line, said first unit conducting current in one direction;

two second units connected between a load capacitor and said first unit, each one of said second units conducting current in one direction;

a resistor having one terminal connected to a scan line and the other terminal connected to a node between said first and second units; and a third unit including a first terminal connected to a node between the second units and said load capacitor and a second terminal connected to a reset line, said third unit conducting current in one direction.

8. The switching element of claim 7, further comprised of one of said first, second, and third units being a junction diode.

9. The switching element of claim 7, further comprised of one of first, second, and third units being a schottky diode.

10. The switching element of claim 7, further comprised of at least one of said first, second, and third units being a metal-insulator-metal diode.

11. The switching element of claim 7, with said load capacitor being a display pixel.

12. The switching element of claim 7, further comprised of the second units being connected in series to each other.

13. A rectification switch, comprising:

a first unit having two terminals with one terminal connected to a data line, said first unit conducting current substantially in only one direction;

two second units being connected between a load capacitor and said first unit, each one of said second units conducting current substantially in only one direction, each one of the two second units having two terminals; and a resistor having one terminal connected to a scan line and the other terminal connected to a node between said first and second units.

14. The switch of claim 13, further comprising of a third unit including a first terminal connected to a node between the second units and said load capacitor and a second terminal connected to a reset line, said third unit conducting current substantially in only one direction.

15. The switch of claim 13, with said load capacitor being a display pixel.

16. The switch of claim 13, further comprised of the second units being connected in series to each other and each one of said second units conducting current substantially in the same one direction.

17. The switch of claim 13, further comprised of the two second units being diodes selected from a group consisting of a junction diode, Schottky diode, and metal-insulator metal diode.

18. The switch of claim 13, being a triodic rectification switch.

* * * * *